US011411348B2

(12) United States Patent
Chen et al.

(10) Patent No.: US 11,411,348 B2
(45) Date of Patent: Aug. 9, 2022

(54) STRESS MECHANISM AND CONNECTOR INCLUDING THE SAME

(71) Applicant: Tarng Yu Enterprise co., ltd., New Taipei (TW)

(72) Inventors: Ying-Chung Chen, New Taipei (TW); Mu-Jung Huang, New Taipei (TW)

(73) Assignee: TARNG YU ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 17/101,834

(22) Filed: Nov. 23, 2020

(65) Prior Publication Data

US 2021/0226384 A1 Jul. 22, 2021

(30) Foreign Application Priority Data

Jan. 20, 2020 (TW) ..... 109200884

(51) Int. Cl.
*H01R 13/631* (2006.01)
*H01R 13/24* (2006.01)

(52) U.S. Cl.
CPC ..... *H01R 13/6315* (2013.01); *H01R 13/2492* (2013.01)

(58) Field of Classification Search
CPC .... H01R 12/57; H01R 12/712; H01R 12/714; H01R 12/716; H01R 13/2435; H01R 13/2442; H01R 13/2492; H01R 13/6315
USPC ..... 439/66, 65
See application file for complete search history.

(56) References Cited

U.S. PATENT DOCUMENTS 5,967,800 A * 10/1999 Bishop ..... H01R 12/714 439/66
5,980,323 A * 11/1999 Bricaud ..... G06K 7/0069 439/630
6,149,443 A * 11/2000 Moran ..... H01R 13/2435 439/66
6,176,707 B1 * 1/2001 Neidich ..... H01R 13/2435 439/66
6,276,941 B1 * 8/2001 Wu ..... H01R 13/2442 439/515
6,290,507 B1 * 9/2001 Neidich ..... H01R 13/2435 439/66
6,293,805 B1 * 9/2001 Wu ..... G06K 7/0021 439/66
6,345,987 B1 * 2/2002 Mori ..... H01R 13/2435 439/66

(Continued)

FOREIGN PATENT DOCUMENTS

CA 2291380 A1 * 6/2000 ..... H01R 13/2442
WO WO-9745900 A1 * 12/1997 ..... H01M 50/50

*Primary Examiner* — Marcus E Harcum
(74) *Attorney, Agent, or Firm* — Chun-Ming Shih; Lanway IPR Services

(57) ABSTRACT

A stress mechanism and a connector including the stress mechanism are provided. When a stress portion of a stress component of the stress mechanism is loaded to a lateral stress or a longitudinal stress, the extent of deformation of a bent structure of the stress portion can be reduced so as to prevent the stress portion from producing yield deformation. This advantageously prolongs lifetime of the connector formed by the stress mechanism, and assures desirable electrical connection performance between the connector and an external device.

11 Claims, 13 Drawing Sheets

(56) References Cited

U.S. PATENT DOCUMENTS 6,398,598 B2 * 6/2002 Masumoto ..... H01R 13/2442 439/862
6,447,338 B1 * 9/2002 Bricaud ..... G06K 7/0021 439/630
6,663,445 B1 * 12/2003 Yeh ..... H01R 13/2442 439/66
6,719,594 B1 * 4/2004 Yuzawa ..... G06K 7/0021 439/66
6,857,906 B2 * 2/2005 Bricaud ..... H01R 12/714 439/630
6,976,851 B2 * 12/2005 Huang ..... H01R 13/2442 439/66
6,984,130 B2 * 1/2006 Richter ..... H01R 13/2435 439/66
7,147,477 B2 * 12/2006 Soh ..... H01R 12/57 439/66
7,341,485 B2 * 3/2008 Polnyi ..... H01R 13/2435 439/591
7,402,049 B2 * 7/2008 Polnyi ..... H01R 12/714 439/66
7,462,037 B2 * 12/2008 Ju ..... H01R 13/2435 439/567
7,785,112 B2 * 8/2010 Hashimoto ..... H01R 13/2435 439/66
7,806,739 B2 * 10/2010 Hu ..... H01R 13/2464 439/862
7,891,983 B2 * 2/2011 Ichimura ..... H01R 13/2435 439/66
7,909,657 B1 * 3/2011 Abughazaleh ..... H01R 24/62 439/676
7,989,045 B2 * 8/2011 Chang ..... H01R 12/57 428/98
8,070,498 B2 * 12/2011 Shen ..... H01R 12/714 439/66
8,454,373 B2 * 6/2013 Cheng ..... H01R 12/57 439/66
9,048,593 B2 * 6/2015 Soo ..... H01R 4/02
9,368,893 B2 * 6/2016 Koyama ..... H01R 13/2428
9,735,479 B2 * 8/2017 Chen ..... H01R 12/57
2007/0197093 A1 * 8/2007 Chen ..... H01R 13/6594 439/607.31
2013/0267103 A1 * 10/2013 Kuwahara ..... H01R 12/7082 439/66
2014/0308825 A1 * 10/2014 Hashiguchi ..... H01R 13/24 439/66
2019/0020134 A1 * 1/2019 Suzuki ..... H01R 12/52
2020/0303854 A1 * 9/2020 Jin ..... H01R 12/721
2020/0343664 A1 * 10/2020 Sakai ..... H01R 13/2442

* cited by examiner

STRESS MECHANISM AND CONNECTOR INCLUDING THE SAME

CROSS-REFERENCE TO RELATED APPLICATIONS

This application claims the priority of Republic of China Patent Application No. 109200884 filed on Jan. 20, 2020, in the State Intellectual Property Office of the R.O.C., the disclosure of which is incorporated herein by reference.

BACKGROUND OF THE INVENTION

Field of the Invention

The present invention relates to connector structures, and more particularly, to a stress mechanism for preventing yield deformation, and a connector including the stress mechanism.

Descriptions of the Related Art

Connectors have been widely applied to forming electrical connection with external equipment. Such electrical connection is usually established by having an external device abutting a stress component of a connector. If the external device, however, does not abut the stress component of the connector at a proper angle or with a proper force, the stress component is liable to yield deformation. When yield deformation happens, the stress component is not able to return to its original shape and thus loses its function.

Therefore, how to prevent yield deformation when the stress component of the connector is loaded to a stress, is an important task to solve in the art.

SUMMARY OF THE INVENTION

In view of the above drawbacks in the prior art, a primary object of the present invention is to provide a stress mechanism and a connector including the stress mechanism, which can prevent yield deformation of a stress component of the stress mechanism so as to prolong lifetime of the connector and improve performance thereof.

For the objects said above and for other objects, the present invention provides a stress mechanism including: a stress component including a first lateral displacement stopping structure and a stress portion, wherein the stress portion has a bent structure; and a base including a second lateral displacement stopping structure; wherein, when the stress portion is loaded to a lateral stress, it has at least one part thereof moving laterally, and the first lateral displacement stopping structure abuts the second lateral displacement stopping structure, so as to reduce deformation of the bent structure and prevent yield deformation of the stress portion.

Optionally, in the stress mechanism said above, wherein the stress component further includes a moving end and a fixed end, which are connected to two opposite ends of the stress portion, and the base further has a receiving space, wherein the fixed end is fixed on the base, and the moving end is movable relative to the base.

Optionally, in the stress mechanism said above, wherein the base further has a first moving space and a second moving space, wherein when the stress portion is loaded to a longitudinal stress, it has at least one part thereof moving longitudinally, and the moving end moves in the first moving space, so as to allow at least one part of the stress portion to submerge in the receiving space, and allow at least one part of the bent structure to move from the receiving space to the second moving space, in order to reduce deformation of the bent structure and prevent yield deformation of the stress portion.

Optionally, in the stress mechanism said above, wherein the bent structure includes a first bent section and a second bent section, wherein when the stress portion is subjected to the longitudinal stress, the first bent section has at least one part thereof submerging in the receiving space, and the second bent section has at least one part thereof moving from the receiving space to the second moving space.

Optionally, in the stress mechanism said above, wherein the first bent section is located at top of the stress portion, and the second bent section is located at bottom of the stress portion.

Optionally, in the stress mechanism said above, wherein the receiving space communicates with the first moving space and the second moving space respectively.

Optionally, in the stress mechanism said above, wherein the first lateral displacement stopping structure includes two wings extended outwardly from a body of the first lateral displacement stopping structure, and the second lateral displacement stopping structure includes two walls for stopping the two wings respectively.

Moreover, the present invention further provides a stress mechanism including: a base including a first moving space, a second moving space and a receiving space; and a stress component including a stress portion and a moving end, wherein the moving end is connected to one end of the stress portion, and the stress portion has a bent structure; wherein, when the stress portion is loaded to a longitudinal stress, it has at least one part thereof moving longitudinally, and the moving end moves in the first moving space, so as to allow at least one part of the stress portion to submerge in the receiving space, and allow at least one part of the bent structure to move from the receiving space to the second moving space, in order to reduce deformation of the bent structure and prevent yield deformation of the stress portion.

Optionally, in the stress mechanism said above, wherein the stress component further includes a fixed end, which is connected to the other end of the stress portion and is fixed on the base.

Optionally, in the stress mechanism said above, wherein the receiving space communicates with the first moving space and the second moving space respectively.

Moreover, the present invention further provides a connector including: two stress mechanisms, each of which is the stress mechanism said above, wherein the two stress mechanisms are symmetrically provided, and the bases of the two stress mechanisms are connected together to form a carrier, with the stress components of the two stress mechanisms being provided on two opposite sides of the carrier.

Optionally, in the connector said above, wherein the connector is an electrical connector, wherein the stress component forms part of a conductive terminal of the electrical connector, and the carrier forms part of an insulating mount of the electrical connector.

Optionally, in the connector said above, wherein the electrical connector is for electrically abutting a conductor that applies a stress to the stress portion.

In summary, the stress mechanism according to the present invention is loaded to a lateral stress and thus has at least one part thereof moving laterally, a first lateral displacement stopping structure of the stress component can abut a second lateral displacement stopping structure of a base of the connector so as to reduce the extent of deformation of a bent structure of the stress mechanism. Moreover, when the stress mechanism according to the present invention is loaded to a longitudinal stress and thus has at least one part thereof moving longitudinally, a moving end of the stress mechanism can move in a first moving space of the base of the connector, so as to allow a part of the stress mechanism to submerge in a receiving space of the base, and allow a part of the bent structure to move from the receiving space to a second moving space of the base, such that the extent of deformation of the bent structure can be reduced. This advantageously prevents yield deformation of the stress mechanism of the connector when being subjected to a stress in different directions, and prolongs lifetime of the connector, as well as assures desirable electrical connection performance between the connector and an external device.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
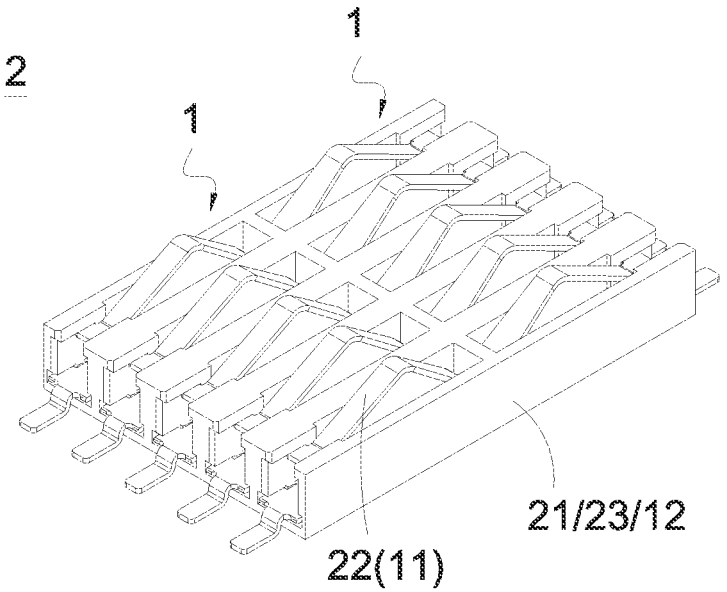
FIGS. 1 to 4 are architectural schematic diagrams of a stress mechanism/connector according to the present invention.
Figure 2:
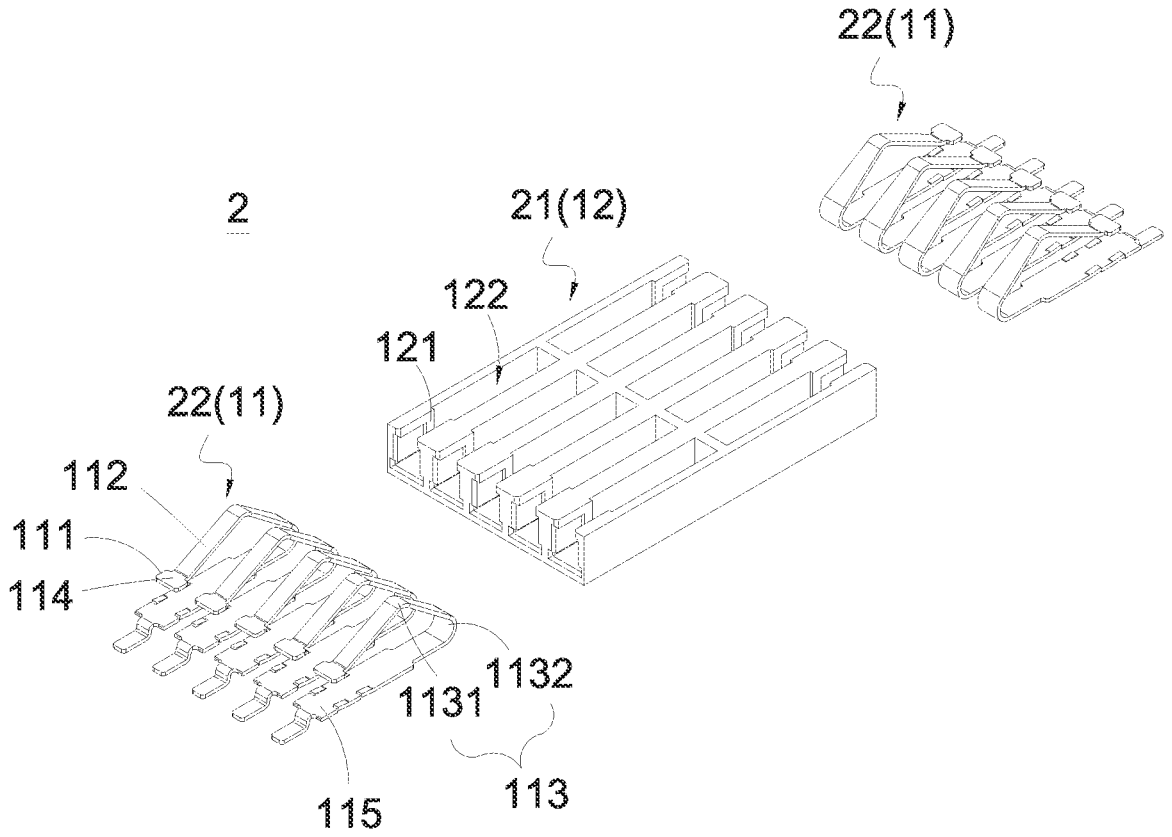
Figure 3:
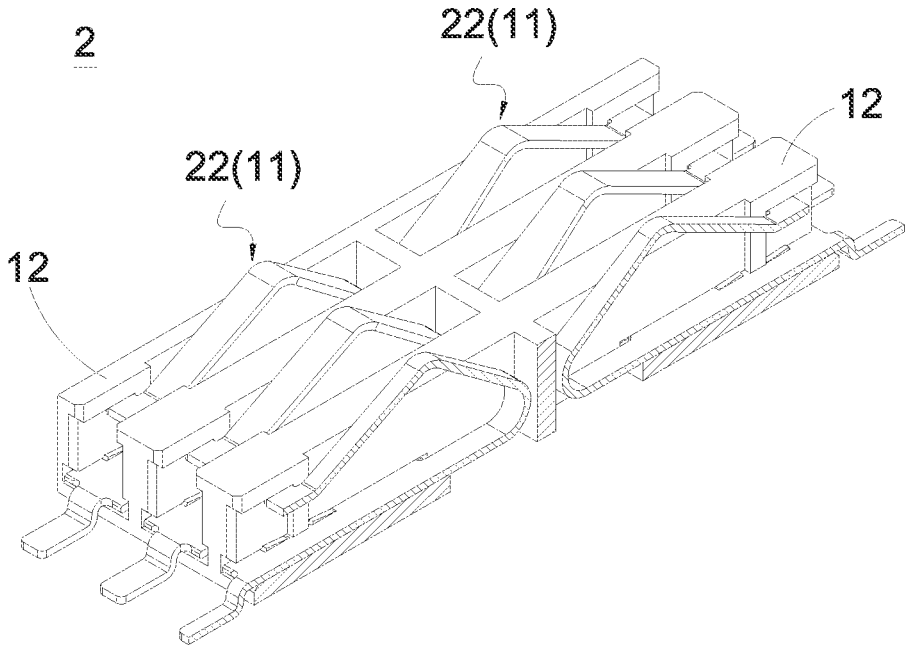
Figure 4:
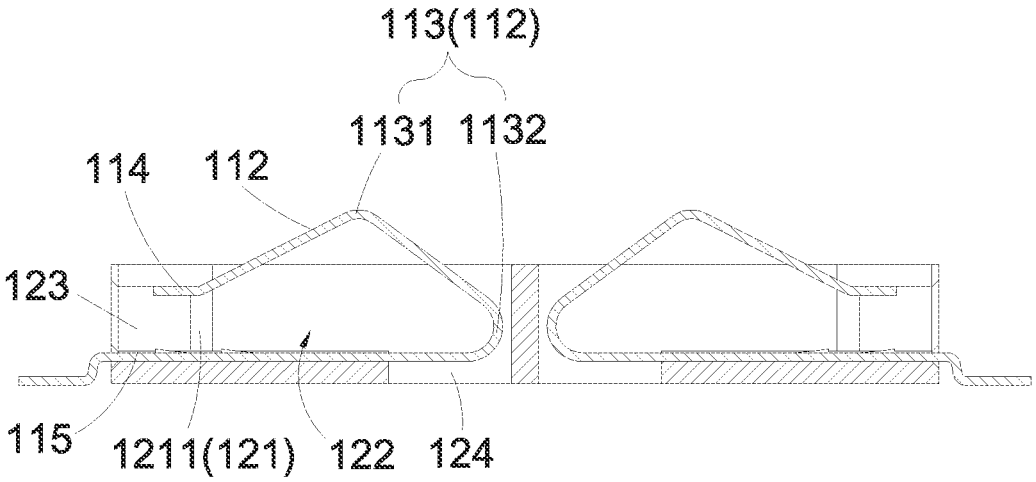

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Figure 5:
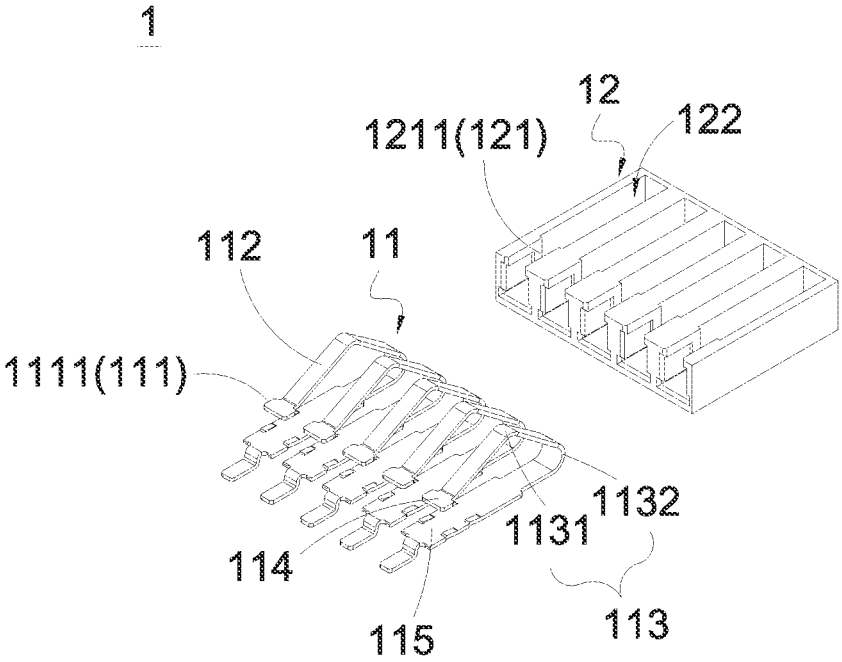
FIG. 5 is an architectural schematic diagram of a stress mechanism/connector according to the present invention.

Refer to the FIGS. 1 to 5, wherein FIGS. 1 to 4 are architectural schematic diagrams of a stress mechanism/connector according to the present invention, FIG. 5 is an architectural schematic diagram of a stress mechanism/connector according to the present invention.

As shown in FIGS. 1 to 5, a connector according to the present invention includes two stress mechanisms 1 that are symmetrically provided. Each of the stress mechanisms 1 includes a stress component 11 and a base 12. The bases 12 of the two stress mechanisms 1 are connected together to form a carrier 21 of the connector. The stress components 11 of the two stress mechanisms 1 are placed on two opposite sides of the carrier 21.

The connector in the present invention is, for example, an electrical connector 2 for electrically abutting a conductor 3, wherein the stress component 11 forms part of a conductive terminal 22 of the electrical connector, and the carrier 21 forms part of an insulating mount 23 of the electrical connector 2.

In the present invention, the stress component 11 includes a first lateral displacement stopping structure 111 and a stress portion 112, wherein the stress portion 112 has a bent structure 113. The bent structure 113 can be formed with a first bent section 1131 and a second bent section 1132, wherein the first bent section 1131 is located at the top of the stress portion 112, and the second bent section 1132 is located at the bottom of the stress portion 112.

The base 12 includes a second lateral displacement stopping structure 121, and a receiving space 122 for accommodating at least one part of the stress component 11. The base 12 further includes a first moving space 123 and a second moving space 124, which respectively communicate with the receiving space 122.

The first lateral displacement stopping structure 111 includes, for example, two wings 1111 extended outwardly from a body of the first lateral displacement stopping structure 111. Correspondingly, the second lateral displacement stopping structure 121 includes, for example, two walls 1211 for respectively stopping the two wings 1111.

As shown in FIGS. 6A to 6E, when the stress portion 112 of the stress component 11 is loaded to a lateral stress F1 and has at least one part thereof experiencing lateral movement, the first lateral displacement stopping structure 111 of the stress component 11 can abut the second lateral displacement stopping structure 121 of the base 12 after the stress portion 112 is moved, and thus stops further lateral movement of the stress portion 112, so as to reduce the extent of deformation of the bent structure 113 and prevent yield deformation of the stress portion 112.

Figure 6A:
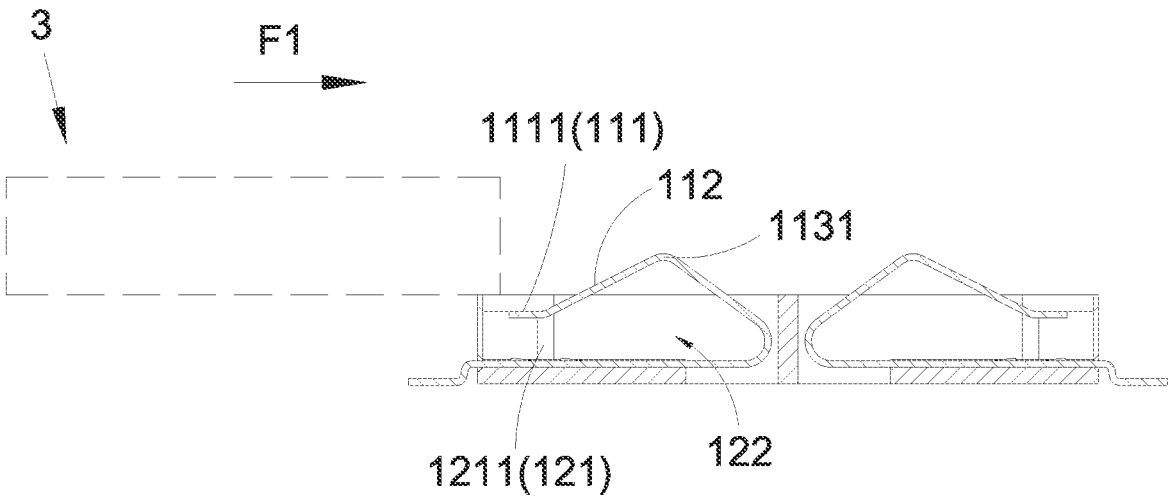
FIGS. 6A to 6E are schematic diagrams showing the stress mechanism/connector of the present invention being subjected to a lateral stress.
Figure 6B:
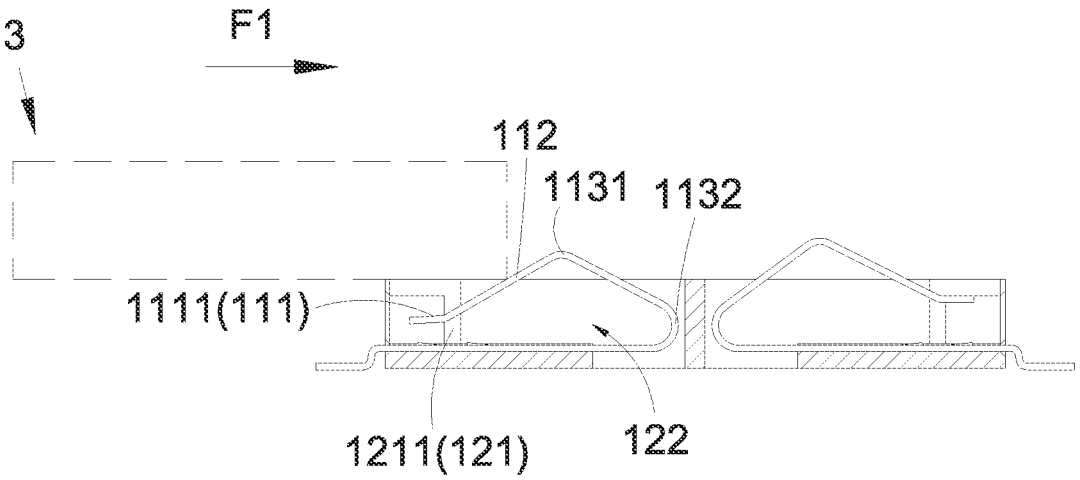
Figure 6C:
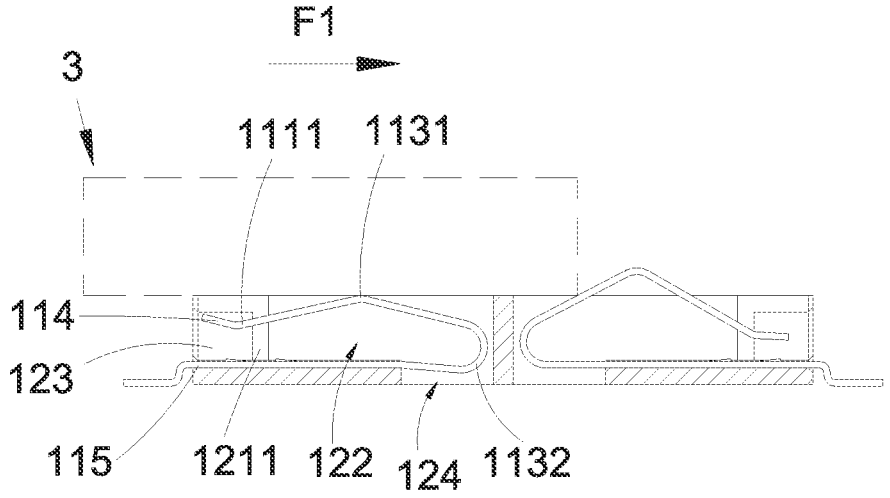
Figure 6D:
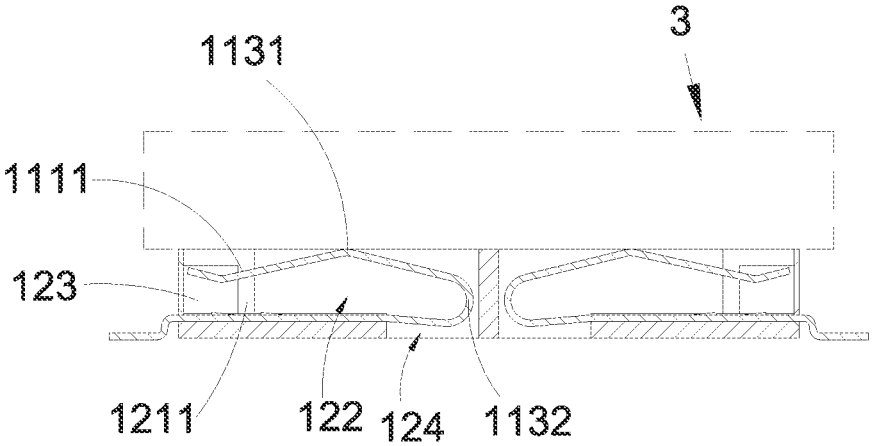
Figure 6E:
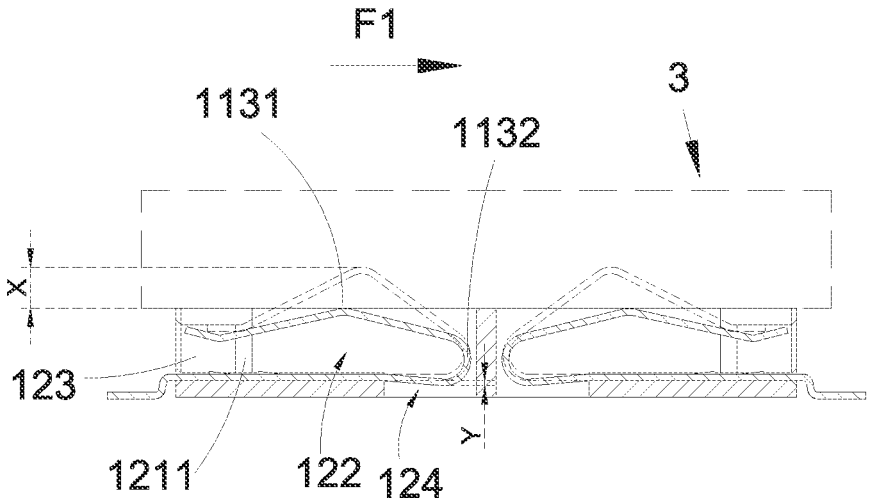

Particularly, when the conductor 3 is pushed towards the electrical connector in the direction of F1 and exerts the lateral stress F1 on the stress portion 112 of the stress component 11, the stress component 11 produces lateral or longitudinal deformation, and a part of the stress portion 112 is moved laterally by the stress F1, making the first bent section 1131 gradually become more bent. In the meantime, the first lateral displacement stopping structure 111 of the stress component 11 abuts the second lateral displacement stopping structure 121 of the base 12 and limits lateral movement of the part of the stress portion 112, which is caused by the lateral stress, to a predetermined maximum distance, so as to control and reduce the extent of deformation of the first bent section 1131, and thereby prevent the first bent section 1131 from producing undesirable yield deformation due to over bending. As shown in FIG. 6E, the first bent section 1131 has at least one part thereof moving a distance X downwardly until it submerges in the receiving space 122, and the second bent section 1132 has at least one part thereof moving a distance Y until it gets into the second moving space 124.

Figure 7A:
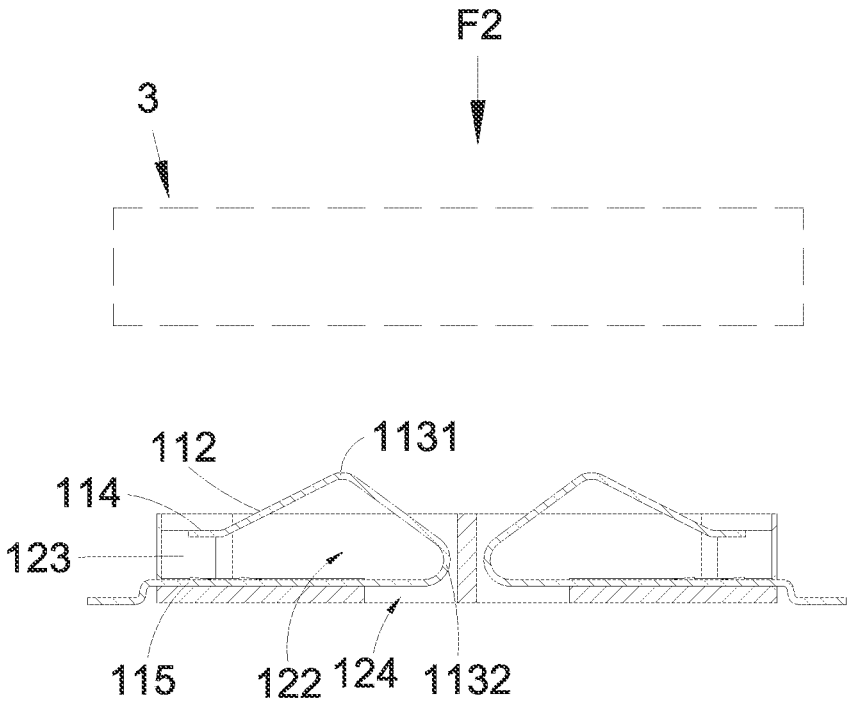
FIGS. 7A to 7C are schematic diagrams showing the stress mechanism/connector of the present invention being subjected to a longitudinal stress.
Figure 7B:
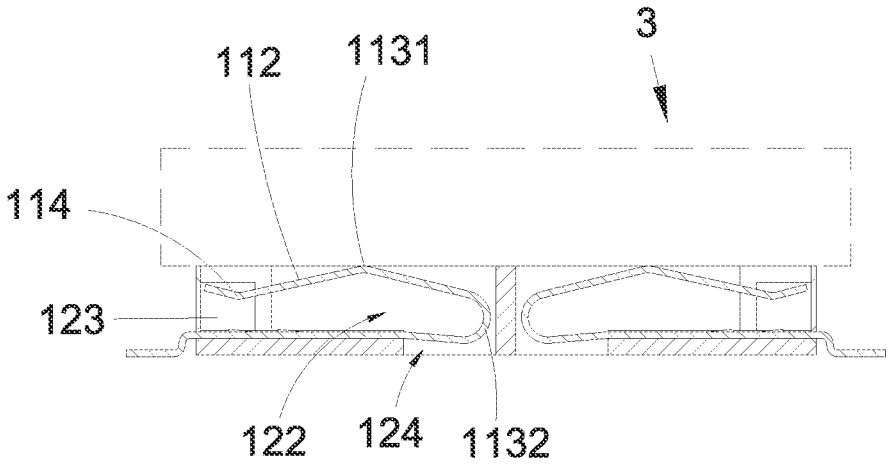
Figure 7C:
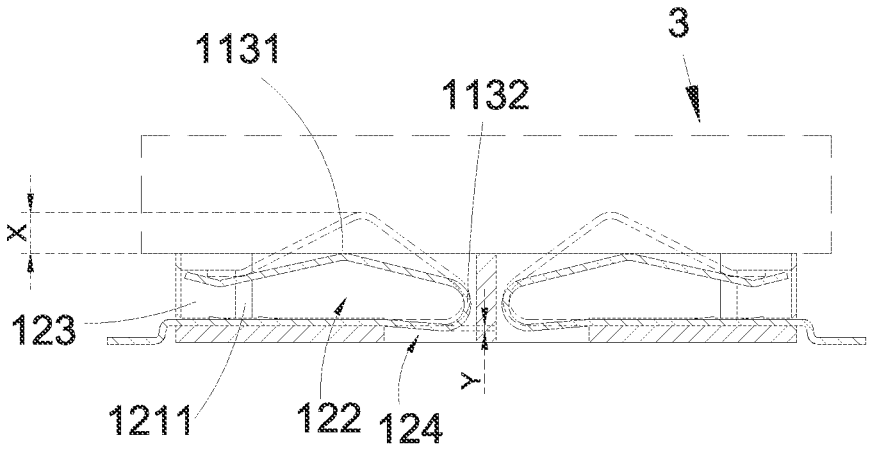

As shown in FIGS. 7A to 7C, the stress component 11 further includes a moving end 114 and a fixed end 115, which are respectively connected to two opposite ends of the stress portion 112. The fixed end 115 is fixed on the base 12, and the moving end 114 is movable relative to the base 12.

When the stress portion 112 is subjected to a longitudinal stress F2 and thus has at least one part thereof moving longitudinally, the moving end 114 can freely move in the first moving space 123 in a manner that, the stress portion 112 has at least one part thereof moving into the receiving space 122, and the bent structure 113 has at least one part thereof moving freely from the receiving space 122 to the second moving space 124, so as to reduce the extent of deformation of the bent structure 113 caused by the stress, and thereby prevent yield deformation of the stress portion 112.

Particularly, when the conductor 3 is pushed in the direction of F2 above and towards the electrical connector 2, it exerts the longitudinal stress F2 on the stress portion 112 of the stress component 11, such that the stress component 11 produces lateral or longitudinal deformation, and the stress portion 112 has a part thereof moving downwardly. In the meantime, as the moving end 114 located at one end of the stress portion 112 can freely move in the first moving space 123, the first bent section 1131 has at least one part thereof moving a distance X downwardly until it submerges in the receiving space 122, and the second bent section 1132 has at least one part thereof moving a distance Y until it gets into the second moving space 124, so as to reduce the extent of deformation of the bent structure 113, and thereby prevent undesirable yield deformation of the stress portion 112.

Therefore, the electrical connector 2 formed by the stress component 11 of the present invention can effectively reduce the extent of deformation of the conductive terminal 22 (that is, the stress component 11) when the electrical connector is loaded to a lateral stress F1 and/or a longitudinal stress F2 from the conductor 3. This advantageously prevents undesirable yield deformation of the conductive terminal 22, and prolongs lifetime of the electrical connector, as well as improves electrical connection performance between the conductive terminal 22 and an external device (that is, the conductor 3).

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A stress mechanism including:

a stress component including a first lateral displacement stopping structure and a stress portion, wherein the stress portion has a bent structure; and a base including a second lateral displacement stopping structure;

wherein, when the stress portion is loaded to a lateral stress, it has at least one part thereof moving laterally, and the first lateral displacement stopping structure abuts the second lateral displacement stopping structure, so as to reduce deformation of the bent structure and prevent yield deformation of the stress portion;

wherein the stress component further includes a moving end and a fixed end, which are connected to two opposite ends of the stress portion, wherein the fixed end is fixed on the base, and the moving end is movable relative to the base;

wherein the base further has a receiving space, a first moving space and a second moving space, wherein when the stress portion is loaded to a longitudinal stress, it has at least one part thereof moving longitudinally, and the moving end laterally moves in the first moving space, so as to allow at least one part of the stress portion to submerge in the receiving space, and allow at least one part of the bent structure to move from the receiving space to the second moving space, in order to reduce deformation of the bent structure and prevent yield deformation of the stress portion; and wherein the stress component laterally moves from the first moving space to the receiving space.

2. The stress mechanism according to claim 1, wherein the bent structure includes a first bent section and a second bent section, wherein when the stress portion is subjected to the longitudinal stress, the first bent section has at least one part thereof submerging in the receiving space, and the second bent section has at least one part thereof moving from the receiving space to the second moving space.

3. The stress mechanism according to claim 2, wherein the first bent section is located at a top of the stress portion, and the second bent section is located at a bottom of the stress portion.

4. The stress mechanism according to claim 1, wherein the receiving space communicates with the first moving space and the second moving space respectively.

5. The stress mechanism according to claim 1, wherein the first lateral displacement stopping structure includes two wings extended outwardly from a body of the first lateral displacement stopping structure, and the second lateral displacement stopping structure includes two walls for stopping the two wings respectively.

6. A stress mechanism including:

a base including a first moving space, a second moving space and a receiving space; and a stress component including a stress portion and a moving end, wherein the moving end is connected to one end of the stress portion, and the stress portion has a bent structure;

wherein, when the stress portion is loaded to a longitudinal stress, it has at least one part thereof moving longitudinally, and the moving end laterally moves in the first moving space, so as to allow at least one part of the stress portion to submerge in the receiving space, and allow at least one part of the bent structure to move from the receiving space to the second moving space, in order to reduce deformation of the bent structure and prevent yield deformation of the stress portion; and wherein the stress component laterally moves from the first moving space to the receiving space.

7. The stress mechanism according to claim 6, wherein the stress component further includes a fixed end, which is connected to the other end of the stress portion and is fixed on the base.

8. The stress mechanism according to claim 6, wherein the receiving space communicates with the first moving space and the second moving space respectively.

9. A connector including:

two stress mechanisms, each of which is the stress mechanism according to claim 6, wherein the two stress mechanisms are symmetrically provided, and the bases of the two stress mechanisms are connected together to form a carrier, with the stress components of the two stress mechanisms being provided on two opposite sides of the carrier.

10. The connector according to claim 9, wherein the connector is an electrical connector, wherein the stress component forms part of a conductive terminal of the electrical connector, and the carrier forms part of an insulating mount of the electrical connector.

11. The connector according to claim 10, wherein the electrical connector is for electrically abutting a conductor that applies a stress to the stress portion.

* * * * *